US007292796B2

(12) United States Patent
Yax

(10) Patent No.: US 7,292,796 B2
(45) Date of Patent: Nov. 6, 2007

(54) METHOD AND SYSTEM FOR ROLLER PAIR ADJUSTMENT

(75) Inventor: Robert John Yax, Springwater, NY (US)

(73) Assignee: Xerox Corporation, Stamford, CT (US)

( * ) Notice: Subject to any disclaimer, the term of this patent is extended or adjusted under 35 U.S.C. 154(b) by 279 days.

(21) Appl. No.: 11/170,390

(22) Filed: Jun. 29, 2005

(65) Prior Publication Data

US 2007/0003301 A1 Jan. 4, 2007

(51) Int. Cl.
*G03G 15/00* (2006.01)

(52) U.S. Cl. ..... 399/45; 399/389

(58) Field of Classification Search ..... 399/38, 399/45, 67, 68, 107, 122, 389
See application file for complete search history.

(56) References Cited

U.S. PATENT DOCUMENTS

| | | | | |
|---|---|---|---|---|
| 4,015,703 | A | 4/1977 | Keller | |
| 4,807,868 | A | 2/1989 | Hirst et al. | |
| 5,336,076 | A | 8/1994 | Waldherr et al. | |
| 5,738,264 | A | 4/1998 | Jackson et al. | |
| 5,815,787 | A | 9/1998 | Crayton et al. | |
| 5,956,543 | A * | 9/1999 | Aslam et al. | 399/45 |
| 5,966,559 | A * | 10/1999 | May et al. | 399/45 |
| 6,215,552 | B1 | 4/2001 | Acquaviva et al. | |
| 6,378,749 | B1 | 4/2002 | Robin | |
| 6,533,154 | B2 | 3/2003 | Kitai et al. | |
| 6,542,712 | B2 * | 4/2003 | Kamijo et al. | 399/328 |
| 6,616,355 | B2 | 9/2003 | Cleary et al. | |
| 6,684,050 | B2 * | 1/2004 | Kiuchi | 399/328 |
| 6,687,468 | B2 | 2/2004 | Holubek et al. | |
| 6,801,727 | B2 | 10/2004 | Maruyama et al. | |
| 6,819,890 | B1 | 11/2004 | Bott et al. | |
| 7,113,717 | B2 * | 9/2006 | Bott et al. | 399/67 |
| 2003/0110961 | A1 | 6/2003 | Bredahl et al. | |
| 2004/0150154 | A1 | 8/2004 | Howe | |
| 2005/0064058 | A1 | 3/2005 | Lake et al. | |

FOREIGN PATENT DOCUMENTS

JP 63-259568 * 10/1988

* cited by examiner

*Primary Examiner*—Hoan Tran
(74) *Attorney, Agent, or Firm*—Maginot, Moore & Beck

(57) ABSTRACT

A method and system for nip gap adjustment of a roller pair such as is used in a printing device with a fusing station for fusing a substance to a substrate and a sheet transfer path for transporting the substrate through the device. The roller pair may be located along the sheet transfer path after the fusing station and includes a first roll having a first axis of rotation and a second roll having a second axis of rotation, the second roll operatively positioned with respect to the first roll so as to transport a substrate with the first roll and the second roll. The device further includes a nip gap changing mechanism for changing the separation between the first axis of rotation and the second axis of rotation to establish a nip gap.

21 Claims, 5 Drawing Sheets

METHOD AND SYSTEM FOR ROLLER PAIR ADJUSTMENT

TECHNICAL FIELD

The presently disclosed embodiments relate generally to printing machines, and more particularly, to printing machines using roller pairs.

BACKGROUND

In electrostatographic processes, a light image of an original document is typically recorded in the form of a latent electrostatic image upon a photosensitive member. The latent image is subsequently developed on the photosensitive member by applying electroscopic marking particles, commonly referred to as toner. The visual toner image is then typically transferred from the photosensitive member to another substrate, such as a sheet of plain paper. The transferred image is then affixed to the substrate, typically by using heat and pressure applied to the substrate at a fusing station.

In order to affix or fuse electrostatic toner material onto a substrate by heat and pressure, the temperature of the toner material is elevated to a point at which the constituents of the toner material coalesce and become tacky while simultaneously applying pressure. This action causes the toner to flow to some extent into the fibers or pores of the substrate. Thereafter, as the toner material cools, it solidifies which causes the toner material to be bonded firmly to the substrate. In the electrostatographic recording arts, the use of thermal energy and pressure for fixing toner images onto a substrate is old and well known.

The substrate is moved, typically from a storage area, through the various stations that perform the above processes by a transport system. There are a variety of transport systems in use that transport and register various substrates, such as paper. In many transport systems, such as those often found in copiers, facsimiles, and printers including inkjet printers and electrostatographic printers, drive mechanisms often include at least one driven elastomer-covered roll backed by a hard idler roll to form a roll pair. The rolls in the roll pair are located on opposite sides of a sheet transport path and one roll may be spring loaded so as to be biased against the second roll. A substrate, such as copy paper, provided to the roll pair is gripped by the roll pair and then advanced by rotation of the roll pair. Thus, the linear movement of the substrate, such as paper, along the sheet transport path requires the roll pair to move apart to form a nip gap small enough allow the substrate through the roll pair while providing sufficient pressure to grip the substrate.

In most conventional transport systems used for printers, copiers and facsimile machines, the types of substrates being transported usually do not vary much. That is, many systems typically encounter only a limited number of different substrate types, such as basic draft sheet stock of a certain weight in basic sizes such as A4 paper or 8.5 inch by 11 inch paper. A typical transport system is designed to transport, for example, 20 lb. bond sheet stock (roughly 75 grams per square meter (GSM)). Occasionally, higher quality bond paper of a slightly higher weight, such as 24 lb. bond (roughly 90 GSM) or 28 lb. bond (roughly 105 GSM) sheet stock is used. These papers typically range from 0.003 inches to 0.004 inches in thickness.

While prior printers, copiers and facsimile machines typically encountered only a handful of different types of substrates, such as A4 or 8.5 inch by 11 inch papers in only a small range of paper weights or densities, today there is a trend toward using more and more diverse varieties of substrates in such systems. These more recent substrates include heavyweight coated papers and media which have a significantly greater thickness than the more traditionally used substrates. The thickness on the heavier substrates may range from 0.008 inches to 0.012 inches. In many instances, the newer and thicker substrates are used when high density images are being reproduced. Thus, the quality of the finished product is generally more closely scrutinized.

A problem arises, however, because the roller pairs along the sheet transport path are designed to provide the desired amount of pressure for substrates substantially narrower than the thickness of the of heavyweight coated substrates. That is, in conventional transport systems, all substrates are transported using the same transport system configuration. Thus, the same configuration of roll pairs is used for all substrates regardless of the type of substrate being used. Accordingly, all of the roll pairs along the sheet transport path are configured to provide the desired pressure for the narrowest thickness of substrate (generally, the lowest weight substrate). The pressure generated by the roll pairs, however, is significantly greater than the pressure needed to transport the heavyweight coated substrates. This results in more compression of the substrate than is required for the roll pair to properly grip the substrate so as to move the substrate along the sheet transport path. Moreover, it is possible for roll marks to be imprinted onto the substrate as a result of the excessive pressure exerted on the substrate.

The problem of over-compression is of particular concern for the roll pairs located after a fusing station. As discussed above with respect to the fusing station of an electrostatographic device, fusing stations subject the substrate to a high temperature and pressure. In an electrostatographic device, this is done in order to melt the toner or other media and force the toner or other media into the substrate. In an ink type printer, a fusing station may be similarly used to fuse an ink image onto a substrate such as by melting a solid ink image transferred to a substrate. Consequently, whenever a fusing process is used to fuse a substance to a substrate, the fusing process causes changes in the substrate that make the substrate more susceptible to blemishes. For example, the high temperature and pressure tends to drive out some of the natural moisture in the substrate causing the substrate to become more brittle. Additionally, a portion of the toner/ink is fused onto the surface of the substrate, making the substrate stiffer. Moreover, both the substrate and the added layer of toner/ink must be forced into roller pairs after the fusing station that are typically configured for thinner substrates.

The resulting over compression of the substrate may result in differential gloss or substrate corrugation leading to discernable and undesired process direction lines in the finished product. For example, particularly with respect to the first roll pair after the fusing station, the fused toner/ink is still relatively warm. Thus, the first roll pair encountered after the fusing station may cause differential cooling of the fused toner/ink leading to differential gloss as well as actually distorting the still warm toner/ink.

SUMMARY

According to aspects illustrated herein, there is provided a printing device with a fusing station for fusing a substance to a substrate and a roller pair located along a sheet transfer path through the device after the fusing station. The roller pair includes a first roll having a first axis of rotation and a second roll having a second axis of rotation wherein the second roll is operatively positioned with respect to the first roll so as to transport a substrate with the first roll and the second roll. The device includes a nip gap changing mechanism for changing the separation between the first axis of rotation and the second axis of rotation to establish a nip gap.

According to aspects illustrated herein, there is further provided a method of transporting a substrate through a device by setting the separation between a first axis of rotation of a first roll in a roller pair and a second axis of rotation in a second roll in the roller pair so as to transport a first substrate. A second substrate is transferred to a fusing station where a substance is fused to the second substrate and the second substrate with the fused substance is transferred to the roller pair. Prior to transporting the second substrate through the roller pair, the separation between the first axis of rotation and the second axis of rotation is changed based upon a characteristic of the second substrate. After the separation between the first axis of rotation and the second axis of rotation is changed, the second substrate is transported through the roller pair.

According to aspects illustrated herein, there is also provided a sheet transport system with a roller pair having a first roll and a second roll operatively positioned with respect to the first roll so as to transport a first substrate with the first roll and the second roll. The sheet transport system includes a lookup table including a plurality of compensation factors, a substrate identification device that identifies the type of a substrate being transported, a nip gap adjustment mechanism for changing the position of the first roll with respect to the second roll so as to establish a nip gap and a nip gap controller operably connected to the nip gap adjustment mechanism and the substrate identification device to associate the identified type of the substrate with one of the plurality of compensation factors and to control the position of the first roll with respect to the second roll based upon the one of the plurality of compensation factors associated with the type of substrate being transported such that when a second substrate is identified, the nip gap is established with a width greater than the thickness of the second substrate.

The above described features and advantages, as well as others, will become more readily apparent to those of ordinary skill in the art by reference to the following detailed description and accompanying drawings.

BRIEF DESCRIPTION OF THE DRAWINGS

By way of example, embodiments will be described with reference to the accompanying drawings, in which.

DETAILED DESCRIPTION

Figure 1:
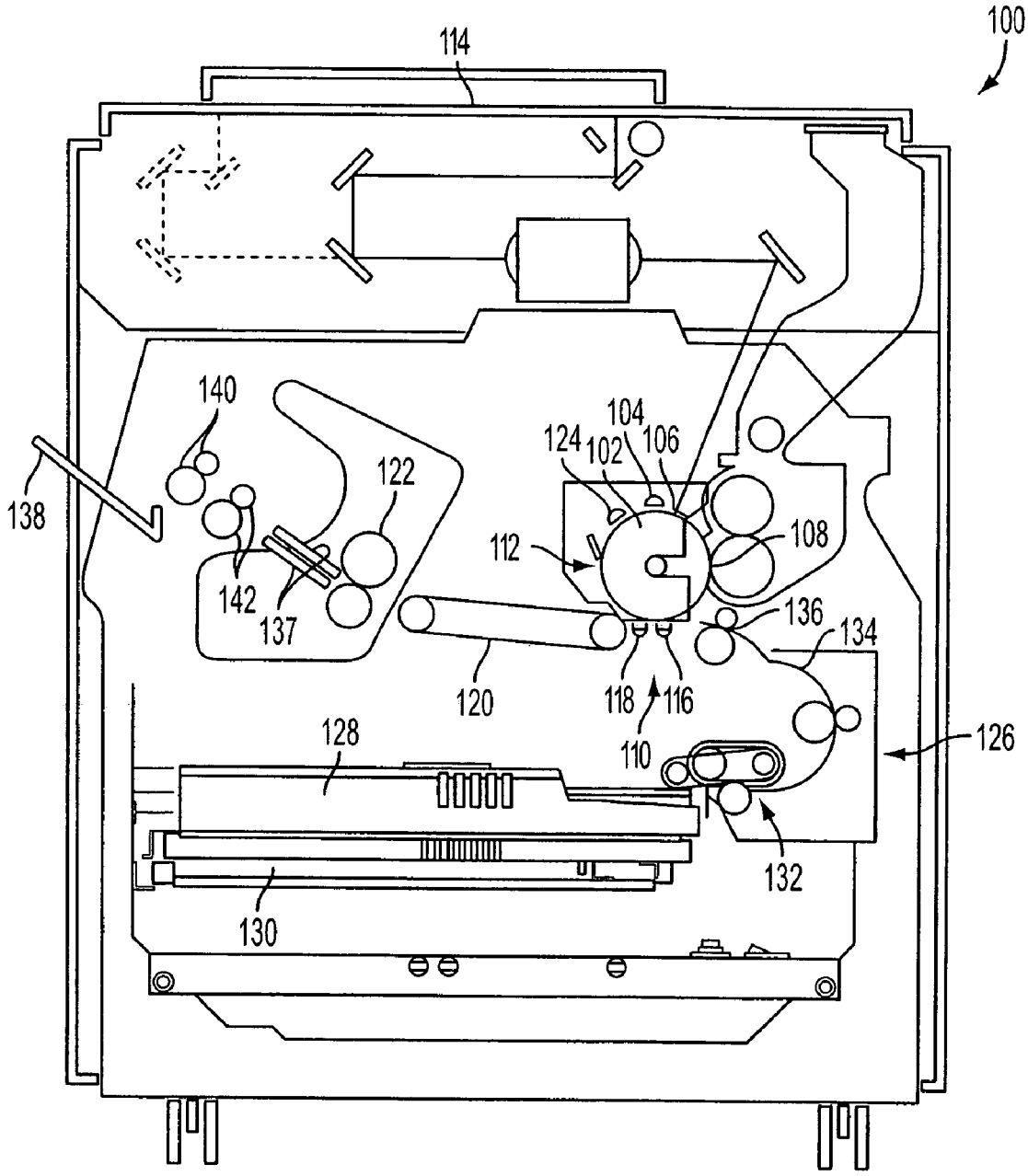
FIG. 1 shows a partial cutaway side elevational view of an exemplary electrophotographic machine incorporating a nip roller pair with an adjustable nip gap.

Referring first to FIG. 1 there is shown a partial cutaway side elevational view of an exemplary electrostatographic machine 100. The machine 100 includes a photoreceptor drum 102 mounted for rotation (in the clockwise direction as seen in FIG. 1) to carry a photoconductive imaging surface of the drum 102 sequentially through a series of processing stations. Namely, a charging station 104, an imaging station 106, a development station 108, a transfer station 110, and a cleaning station 112.

The general operation of the machine 100 begins by depositing a uniform electrostatic charge on the photoreceptor drum 102 at the charging station 104 such as by using a corotron. A document to be reproduced that is positioned on a platen 114 is scanned by means of a moving optical scanning system to produce a flowing light image on the drum 102 at the imaging station 106. The flowing light image selectively discharges the electrostatic charge on the photoreceptor drum 102 in the image of the document, whereby an electrostatic latent image of the document is laid down on the drum 102.

At the development station 108, the electrostatic latent image is developed into visible form by depositing toner particles on the charged areas of the photoreceptor drum 102. Cut sheets of a substrate are moved into the transfer station 110 in synchronous relation with the latent image on the drum 102 and the developed image is transferred to the substrate at the transfer station 110. A transfer corotron 116 provides an electric field to assist in the transfer of the toner particles to the substrate. The substrate is then stripped from the drum 102, the detachment being assisted by the electric field provided by an alternating current de-tack corotron 118. The substrate carrying the transferred toner image is then carried by a transport belt system 120 to a fusing station 122.

After transfer of the toner image from the drum 102, some toner particles usually remain on the drum 102. The remaining toner particles are removed at the cleaning station 112. After cleaning, any electrostatic charges remaining on the drum are removed by an alternating current erase corotron 124. The photoreceptor drum 102 is then ready to be charged again by the charging station 104, as the first step in the next copy cycle.

The transport of the substrate to the transfer station 110 in the above process is accomplished by a substrate supply system 126. In this embodiment, the substrate is selected from one of two types of substrate stored in two substrate trays, an upper, main tray 128 and a lower, auxiliary tray 130. The top sheet of substrate in the selected tray is brought, as required, into feeding engagement with a common, fixed position, sheet separator/feeder 132. The sheet separator/feeder 132 feeds sheets around a curved guide 134 for registration at a registration point 136. Once registered, the sheet is fed into contact with the drum 102 in synchronous relation to the toner image so as to receive the toner image on the drum 102 at the transfer station 110.

The substrate carrying the transferred toner image is transported, by the transport belt system 120, to the fusing station 122, which is a heated roll fuser. The heat and pressure in the nip region between the two rolls of the fuser (or a fuser roll and a pressure belt) cause the toner particles to melt and some of the toner is forced into the fibers or pores of the substrate. The substrate with the fused image is then fed by the rolls in the fusing station 122 into a catch tray 138 via guides 137 and the output roll pairs 140 and 142.

Figure 2:
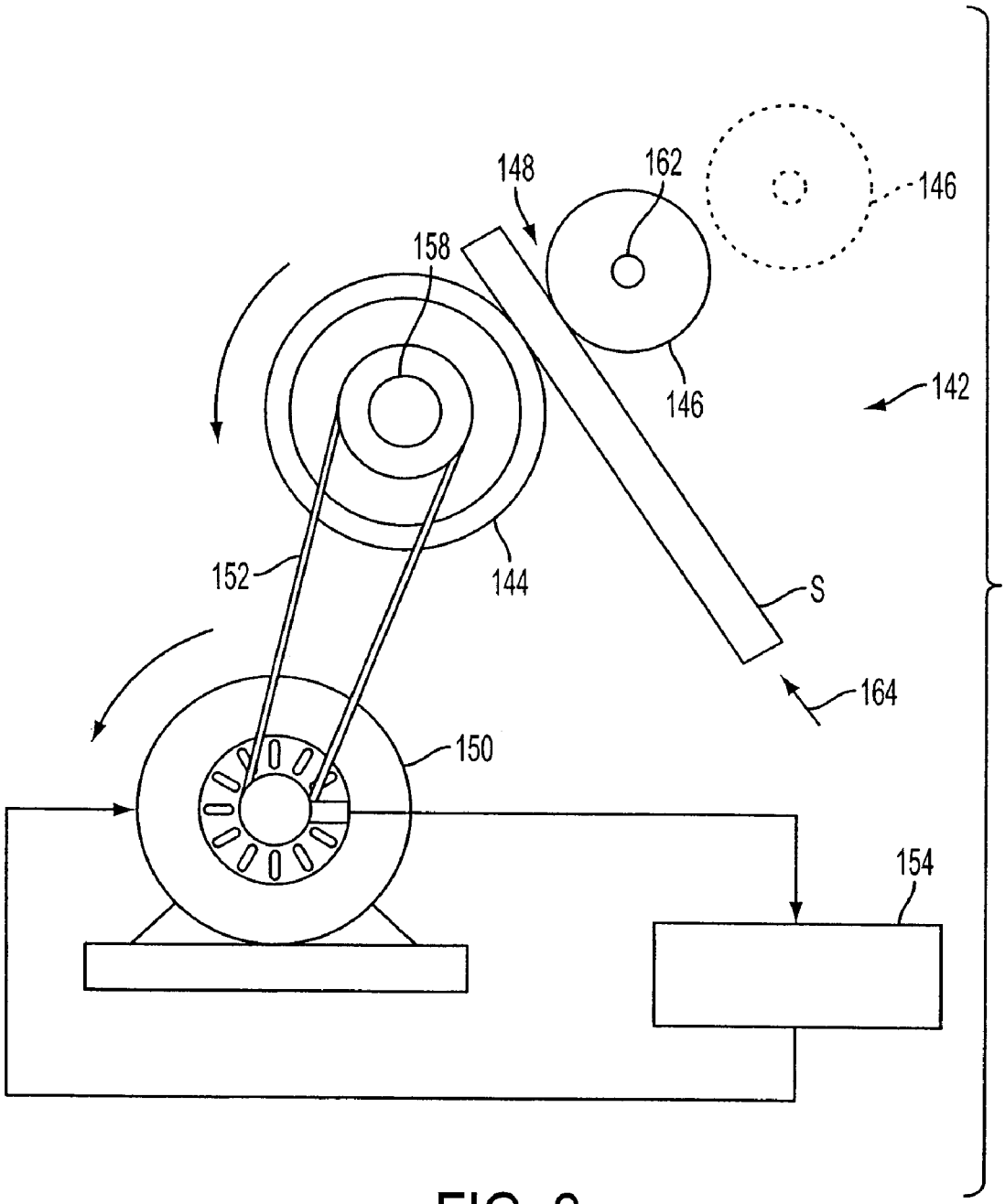
FIG. 2 shows a side elevational view of the nip roller pair with an adjustable nip gap used in the electrophotographic system of FIG. 1.

As shown in FIG. 2, the output roll pair 142 includes a drive roll 144 and an idle roll 146 that is shown spaced apart from the drive roll 144 by a substrate S thereby defining a nip gap 148. The idle roll 146 is biased against the drive roll 144 by a spring 182 (see FIG. 3) such that in the configuration of FIG. 2, the idle roll 146 would be in contact with the drive roll 144 if the substrate S were not being transported by the roll pair 142. The drive roll 144 is connected to a process motor 150 in this embodiment by a belt 152.

In operation, the process motor is controlled by a process controller 154. Thus, as a substrate S passes the fusing station 122, the substrate S will abut both the drive roll 144 and the idle roll 146. The process controller 154 controls the process motor 150 to rotate in the counterclockwise direction as shown in FIG. 2. Because the drive roll 144 is operatively connected to the process motor 150 by the belt 152, the drive roll 144 also rotates in the counterclockwise direction about an axis of rotation 156 (see FIG. 3) through the center of the axle 158 of the drive roll 144. The idle roll 146 is free to rotate about an axis of rotation 160 through the center of the axle 162 of the idle roll 146. Accordingly, as the drive roll 144 rotates, the substrate S is gripped by the roll pair 142 as the idle roll 146 is forced away from the drive roll 144 against the bias of the spring 182. The substrate S is thus gripped by the roll pair 142 and forced along the transport path in the direction of arrow 164.

The foregoing operation is typically used when the substrate S is a normal weight substrate. When the substrate S to be transported is a thicker substrate, however, the substrate S will generally have sufficient stiffness to be properly transported to the tray 138 using only the roll pair 140. Specifically, substrates with high stiffness require fewer roller pairs to control/guide the substrates through the paper path. Thus certain roller pairs maybe opened up or disabled when stiff substrates are being fed through the system resulting in the decrease or elimination of roller mark defects caused by the roller pair. Of course, when roller pairs are opened or disabled, it is generally desired to ensure that the resulting distance between operable roller pairs does not exceed the length of the substrate being transported in order to maintain positive control over the movement of the substrate. Thus, in one embodiment the length of the substrate may be used in determining whether or not particular roller pairs are opened or disabled.

In the embodiment of FIG. 1, when a heavy weight substrate is being transported, the relative position of the drive roll 144 and the idle roll 146 is modified to eliminate exerting pressure on the substrate with the idle roll 146. The relative position of the drive roll 144 and the idle roll 146 is controlled by a nip gap changing mechanism 166 shown in FIG. 3. In this embodiment, the nip gap changing mechanism 166 includes a solenoid 168, a crank arm 170 a support arm 172. The crank arm 170 is operably connected to the solenoid 168 at one end through a pin 174 that is free to rotate with respect to both the crank arm 170 and the solenoid 168. The other end of the crank arm 170 is slidably connected to the support arm 172. Specifically, a pin (not shown) is maintained within a slot 176 in an extension 178 that is fixedly connected to the support arm 172. A fixed pivot pin 180 is located in a central portion of the crank arm 170 and a spring 182 is attached to the pin 174 so as to bias the pin 174 toward the solenoid 168.

The support arm 172 is rotatably mounted to the electrostatographic machine 100 at both ends (not shown). The support arm 172 is fixedly attached to an extension 184 that rotatably holds the axle 162 of the idle roll 146.

Figure 4:
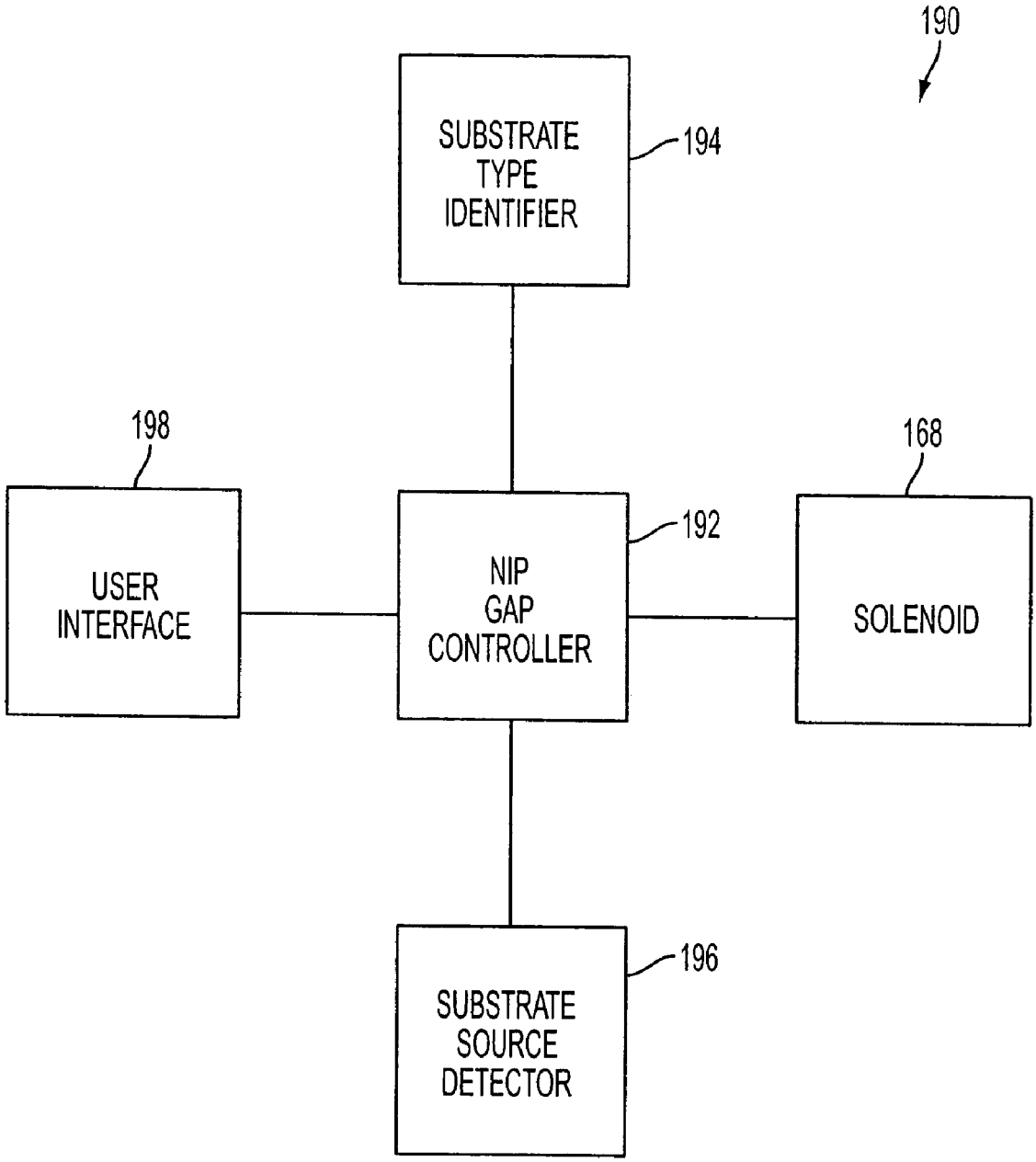
FIG. 4 shows a block diagram of an exemplary nip gap control circuit.

The operation of the nip gap changing mechanism 166 is controlled by a nip gap control system 190 shown in FIG. 4. The nip gap control system 190 includes a nip gap controller 192, a substrate type identifier 194, a substrate source detector 196 and a user interface device 198. The substrate type identifier 194 is used to determine the type of substrate based upon sensed characteristics of the substrate such as thickness. Sensors which may suitably be used to determine the thickness of a substrate are disclosed in U.S. Pat. No. 6,215,552 B1 assigned to Xerox Corporation, the disclosure of which is incorporated herein by reference in its entirety.

The substrate source detector 196 determines the source of the substrate on which an image will be fused. The substrate source detector 196 may make this determination, by way of example, based upon the substrate source selected by a user on a control panel or by a sensor which detects the particular tray that is aligned with the substrate supply system 126. When using the source detector 196 to determine the type of substrate on which an image will be fused, the substrate supplied by the particular source is associated with a particular type of substrate. By way of example, upon loading of a tray with copy paper, the paper may be imbedded with an encoding that identifies the type of copy paper. Alternatively, the substrate may be supplied in a module or packaging which is similarly encoded. Based upon this encoding, a lookup table may be accessed that associates the type of copy paper with a particular thickness.

The user interface device 198 may be any device operable to receive input from an operator such as a keypad or a voice recognition system. In one embodiment, the user interface device 198 is a menu driven graphical user interface which provides a list of potential substrate types so that the operator may select the appropriate substrate type by pressing a touch sensitive screen.

Those of ordinary skill in the art will appreciate that in different embodiments only one of the substrate type identifier 194, the substrate source detector 196 or the user interface device 198 or other devices may be used in a nip gap control system. Alternatively, various combinations of devices may be used to identify the substrate upon which an image is or will be fused.

Figure 5:
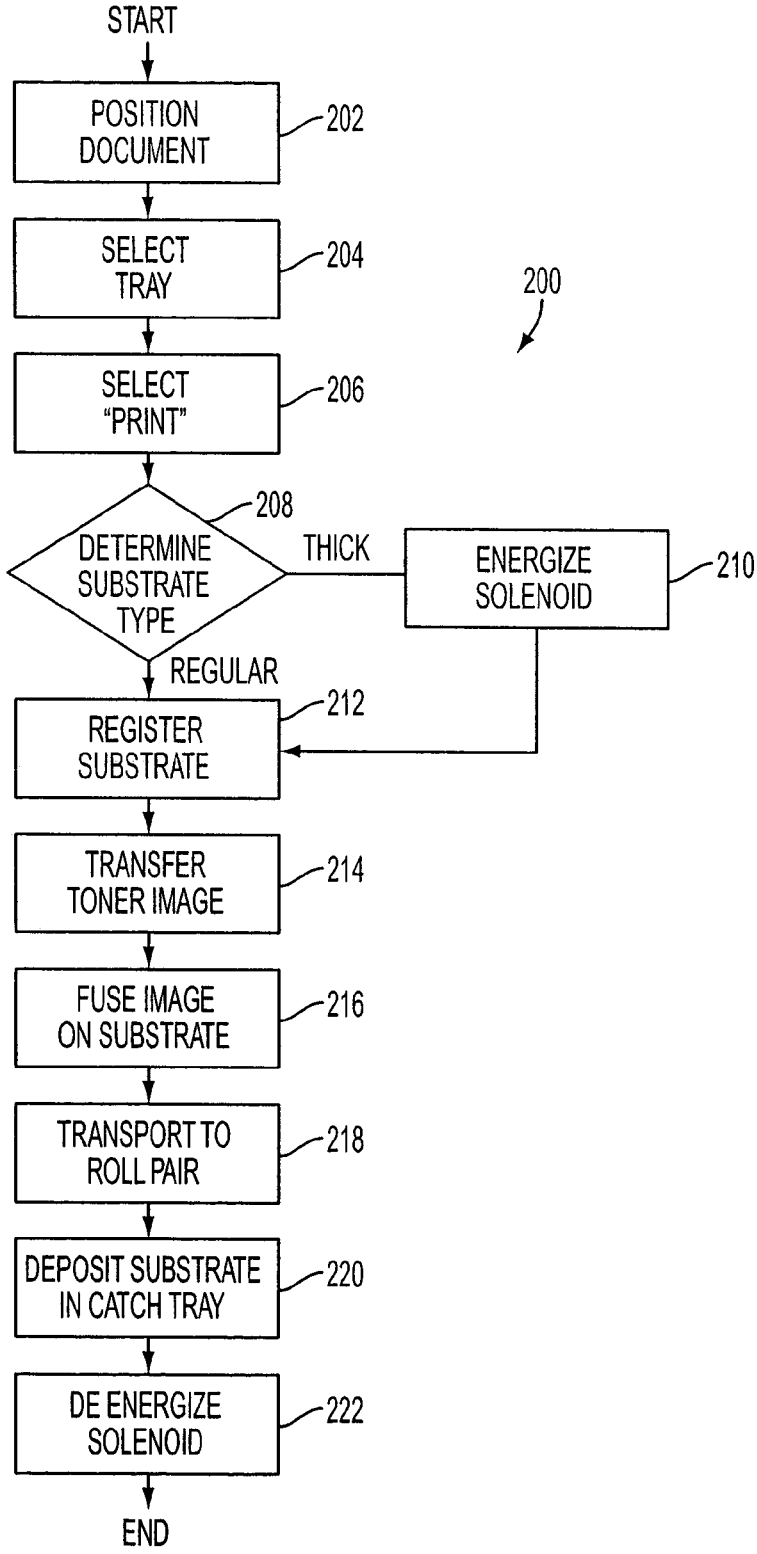
FIG. 5 shows a method for changing the nip gap of a roller pair based upon the type of substrate that is to be transported by the roller pair.

Operation of the electrostatographic machine 100 is discussed in reference to the process 200 shown in FIG. 5. At the step 202, a user places a document to be copied on the platen 114 and selects, in this example, the auxiliary tray 130 as the substrate source at the step 204. Next, the user selects "print" at the control panel (not shown) of the electrostatographic machine 100 at the step 206. At the step 208 the nip gap controller 192 determines the type of the substrate on which the image of the document will be fused. In this embodiment, the nip gap controller identifies the substrate as one of two types, either "regular" or "thick".

The determination of the type of the substrate may be based upon either a user input, a thickness detector, a substrate source detector, or some combination of the foregoing. Of course, the timing of the determination step may also vary based upon the embodiment. By way of example, if only user input is used to identify the type of substrate, then the user input will normally occur prior to moving the substrate into the substrate supply system. If a sensor is used, then the type of substrate may be identified when the substrate is placed into a tray or at some point along the sheet transport path so as to identify the substrate prior to transport of the substrate by the roll pair 142. In one embodiment, a thickness detector is positioned at the registration point.

In the process 200, the type of substrate loaded into the auxiliary tray 130 was identified to the nip gap controller 192 as being a thick type when the auxiliary tray 130 was loaded. Accordingly, at the step 208, the nip gap controller 192 determines that because the auxiliary tray 130 has been selected as the source of the substrate, the substrate on which the image of the document will be fused is a "thick" type. Therefore, the process 200 proceeds to the step 210 and the solenoid 168 is energized.

Figure 3:
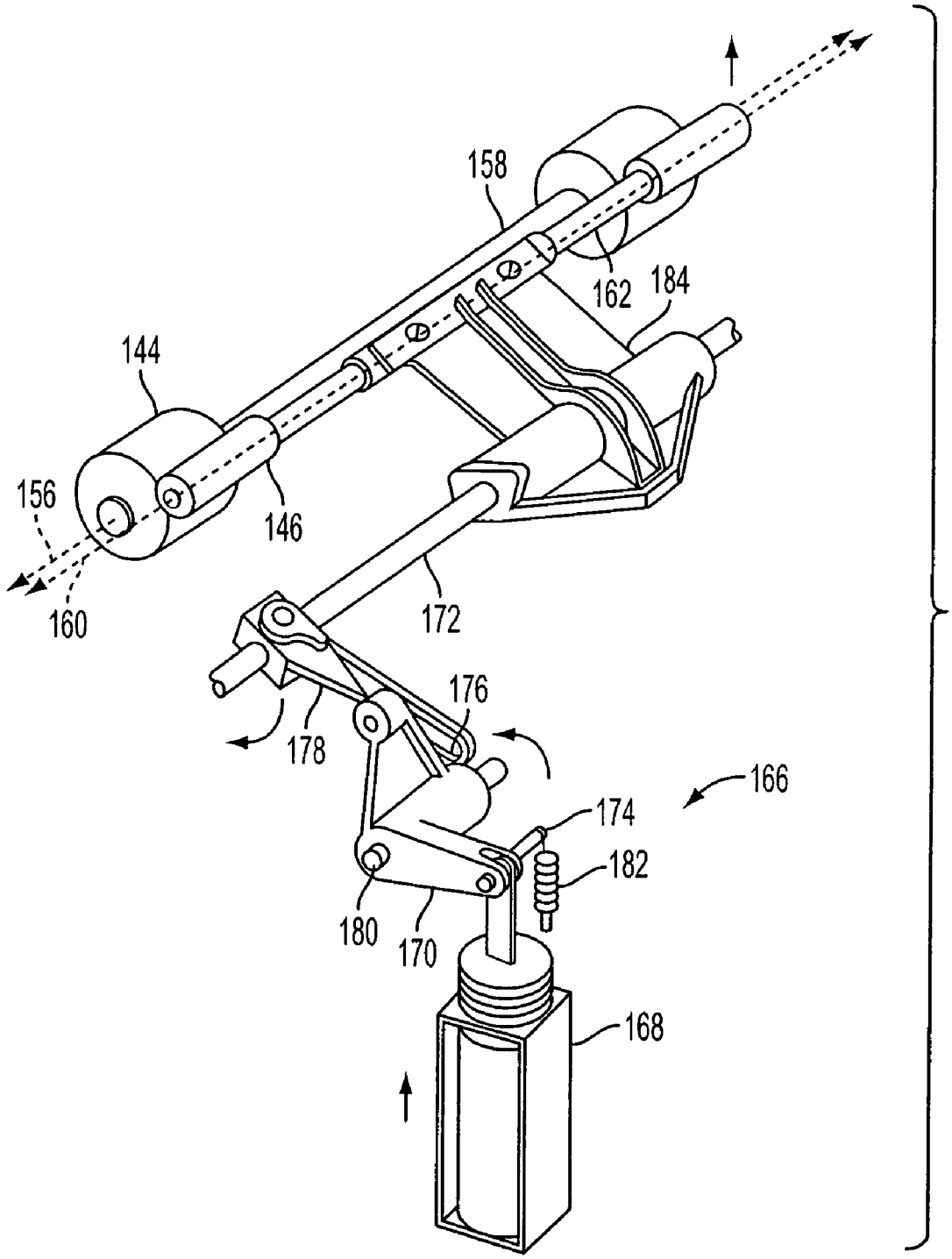
FIG. 3 shows a perspective elevational view of a nip gap changing mechanism that may be used in electrophotographic machine of FIG. 1.

Energization of the solenoid 168 causes the solenoid piston to overcome the bias of the spring 182 and move in the direction of the pin 174 (see FIG. 3). This forces the crank arm 170 to rotate in a counterclockwise direction around the fixed pivot pin 180. The counterclockwise movement of the crank arm 170 is translated into a clockwise rotation of the support arm 172 as the pin (not shown) of the crank arm 170 moves within the slot 176 of the extension 178. As the support arm 172 rotates in the clockwise direction, the idle roll 146 is moved away from the drive roll 144 to the alternate position shown in FIG. 2. The process 200 then continues to the step 212.

In the event the substrate in the auxiliary tray 130 had been identified as a regular thickness sheet, the nip gap controller 192 would determine that the substrate on which the image of the document will be fused is a regular type substrate and the process would continue directly to the step 212. Thus, the solenoid 168 would not be energized, and the bias of the spring 182 would maintain the idle roll 146 in contact with the drive roll 144.

At the step 212, the selected substrate is transported by the substrate supply system 126 to the registration point 136 where the substrate is registered. The substrate is then moved to the transfer station 110 at the step 214 where the developed image of the document to be copied is transferred to the substrate. At the step 216, the substrate is transported to the fusing station 122 and the developed image on the substrate is fused to the substrate.

At the step 218 the fused substrate is transported to the roll pair 142. In this embodiment, the movement of the support arm 170 at the step 210 has created a nip gap between the idle roll 146 and the drive roll 144 that exceeds the thickness of the thick substrate. Accordingly, when the substrate is transported to the roll pair 142, the substrate is not gripped by the roll pair 142. The process controller 154, however, continues to control the process motor 150 which, as described above, causes the drive roll 144 to rotate. This assists in the deposition of the substrate into the catch tray 138 at the step 220. In alternative embodiments, the process motor 150 may be de-energized. In further embodiments, the nip gap may be controlled to a wider dimension that is still less than the thickness of the thick substrate.

At the step 222, power to the solenoid 168 is removed. When the power is removed from the solenoid 168, the biasing force of the spring 182 forces the piston of the solenoid 168 back into the solenoid housing, thus reversing the process described above with respect to the step 210. Accordingly, the idle roll 146 is moved back into its original position wherein there is no nip gap between the idle roll 146 and the drive roll 144. Thus, in the event a regular type substrate is selected, the fused regular type substrate will be gripped by the roll pair 142. The process 200 then ends.

Those of ordinary skill in the art will appreciate that the above described method and apparatus may be modified in a number of additional ways. By way of example, the position of the rolls in a roller pair may be changed by the use of a cam, a rotary knob, a lever, and/or a motor. Additionally, the mechanism can be activated by either a manually operated lever linkage system (controlled by an operator) or by an automatic system utilizing hardware and software to identify the substrate and properly adjust/set the position of the rolls in a roller pair.

Moreover, while the above described embodiment identified two settings, a plurality of settings may be incorporated. Accordingly, in one embodiment, a motor is used to turn a worm gear so as to rotate the support arm to a desired position. In yet a further embodiment, there are more than two nip roller pairs after the fusing station and the nip gap control system controls the relative positions of rolls in more than one roller pair.

Moreover, various implementations of machines incorporating a nip gap control system are contemplated. In one embodiment, an inkjet printer or electrostatographic machine is intended for a high end user, such as a graphic artist or press operator in a commercial print shop where high-end machines are used. In such an environment, the operator is typically very knowledgeable about the particular copy and print services being used, as well as the various media/substrates and toner desired and used. As such, in this embodiment, an operator is likely to be knowledgeable enough to appropriately select from a large number of available media/substrate types the correct media/substrate type and/or the desired nip gap for a particular job. This information can be entered into the machine by way of keyboard, touchscreen or any other input device. One suitable exemplary embodiment would display available substrate types from a substrate database resident in the machine on a display for the operator to review and select the appropriate substrate type. Alternatively, the user interface may simply incorporate a "nip open/nip shut" button.

Once the appropriate substrate type has been identified, the machine accesses a lookup table to obtain data indicative of the nip gap to be used with the substrate type. While it is possible to provide a lookup value with a nip gap compensation factor for each different type or variety of substrate, such an embodiment is more memory intensive and software complex. Additionally and/or alternatively, various nip gap settings may be displayed for selection.

An alternative embodiment groups two or more substrates into various subgroups. That is, in an exemplary embodiment where the range of substrate types is broken down into groups, each of these groups could have associated therewith a stored compensation factor for that group that corresponds to the average variation of the group. Although this may not be as accurate as use of individual compensation factors for each substrate type, the compensation can be an improvement over no compensation at all.

Thus, in one embodiment, a nip gap control system is incorporated into low-end electrostatographic or ink based machines or electrostatographic or ink based machines intended for general walk-up use. In such an environment, the operators are usually less sophisticated. As such, it may not be reliable or desirable to have such an operator identify the media/substrate type being used from a large number of substrate type possibilities. This is particularly the case when physical properties of the substrates, such as thickness, are often unknown to the less-skilled user.

Accordingly, for this environment, it would be more convenient (and more reliable) for the operator to have a much simpler, reduced subset of substrate types to distinguish between. By way of example, most users are familiar with the feel of traditional copy paper. Most users are further able to identify a particular substrate as being lighter or heavier than the traditional copy paper. Finally, thinner substrates are frequently lighter than traditional copy paper and thicker substrates tend to be heavier than traditional copy paper. Therefore, in this embodiment, all media/substrate types are categorized into three groups: lightweight (thin) substrates, normal or medium substrates, and heavyweight (thick) substrates. Such a reduced set of media types makes it easier for a less sophisticated operator to select a substrate type that fairly represents characteristics of the substrate being used, while still providing a mechanism that fairly reliably compensates for substrates of different thicknesses.

It will be appreciated that various of the above-disclosed and other features and functions, or alternatives thereof, may be desirably combined into many other different systems or applications. Various presently unforeseen or unanticipated alternatives, modifications, variations or improvements therein may be subsequently made by those skilled in the art which are also intended to be encompassed by the following claims.

What is claimed is:

1. A printing device comprising:

a fusing station for fusing a substance to a substrate;

a sheet transfer path for transporting the substrate through the device; and a roller pair located along the sheet transfer path after the fusing station and including a first roll having a first axis of rotation;

a second roll having a second axis of rotation, the second roll operatively positioned with respect to the first roll so as to transport the substrate with the first roll and the second roll; and a nip gap changing mechanism for changing the separation between the first axis of rotation and the second axis of rotation to establish a nip gap.

2. The device of claim 1, further comprising:

an imaging station for recording an electrostatic latent image on a photoconductive surface;

a development station for developing an image on the photoconductive surface; and a transfer station for transferring the image to the substrate.

3. The device of claim 1, wherein the nip gap changing mechanism comprises a mechanical selector movable between a first position and a second position wherein when the mechanical selector is moved from the first position to the second position the separation between the first axis of rotation and the second axis of rotation is increased.

4. The device of claim 1, further comprising:

a nip gap controller operably connected to the nip gap changing mechanism to control the separation between the first axis of rotation and the second axis of rotation.

5. The device of claim 4, further comprising:

a lookup table including a plurality of compensation factors, each of the plurality of compensation factors associated with one of a plurality of substrate types; and a substrate identification device that identifies the substrate being transported as one of the plurality of types, wherein the nip gap controller accesses the lookup table based upon the identified type of substrate and uses the one of the plurality of compensation factors associated with the identified one of the plurality of substrate types and controls the nip gap changing mechanism based upon the one of the plurality of compensation factors.

6. The device of claim 5, wherein the substrate identification device comprises a user input device for receiving input identifying the type of substrate.

7. The device of claim 5, wherein the substrate identification device comprises a sensor for detecting the thickness of the substrate being transported.

8. The device of claim 5, wherein the substrate identification device comprises a sensor for detecting a source from which the substrate is transported to the fusing station.

9. A method of transporting a substrate through a device comprising:

setting the separation between a first axis of rotation of a first roll in a roller pair and a second axis of rotation in a second roll in the roller pair so as to transport a first substrate with the roller pair;

transporting a second substrate to a fusing station;

fusing a substance to the second substrate;

transporting the second substrate with the fused substance to the roller pair;

changing the separation between the first axis of rotation and the second axis of rotation based upon a characteristic of the second substrate; and transporting the second substrate through the roller pair after changing the separation.

10. The method of claim 9, wherein changing the separation comprises:

moving a mechanical selector from a first position to a second position.

11. The method of claim 9, wherein changing the separation comprises:

controlling the separation between the first axis of rotation and the second axis of rotation with a nip gap controller.

12. The method of claim 11, wherein changing the separation further comprises:

identifying the second substrate as one of a plurality of substrate types;

associating the identified substrate type of the second substrate with a compensation factor; and controlling the nip gap changing mechanism with the nip gap controller based upon the associated compensation factor.

13. The method of claim 12, wherein identifying the second substrate comprises:

receiving input from a user input device identifying the type of substrate.

14. The method of claim 12, wherein identifying the second substrate comprises:

detecting the thickness of the second substrate with a sensor.

15. The method of claim 12, wherein identifying the second substrate comprises:

determining the source from which the second substrate is transported to the fusing station.

16. The method of claim 9, wherein the first substrate has a thickness and changing the separation comprises:

changing the separation between the first axis of rotation and the second axis of rotation such that the nip gap formed between the first roll and the second roll is greater than the thickness of the first substrate.

17. The method of claim 16, wherein the second substrate has a thickness and changing the separation comprises:

changing the separation between the first axis of rotation and the second axis of rotation such that the nip gap formed between the first roll and the second roll is greater than the thickness of the second substrate.

18. A sheet transport system comprising:

a sheet transfer path for transporting a substrate with a fused image away from a fusing station;

a roller pair located along a sheet transfer path after the fusing station, the roller pair having a first roll with a first axis of rotation and a second roll with a second axis of rotation, the second roll being operatively positioned with respect to the first roll so as to transport a first substrate with the first roll and the second roll;

a lookup table including a plurality of compensation factors;

a substrate identification device that identifies a type for a substrate being transported on the sheet transfer path;

a nip gap adjustment mechanism for changing the position of the first axis of rotation for the first roll with respect to the second axis of rotation for the second roll to establish a nip gap; and a nip gap controller operably connected to the nip gap adjustment mechanism and the substrate identification device to associate the identified type of the substrate with one of the plurality of compensation factors and to control the position of the first axis of rotation with respect to the second axis of rotation with reference to the one of the plurality of compensation factors associated with the type of substrate being transported to establish the nip gap with a width greater than the thickness of the identified substrate.

19. The sheet transport system of claim 18, wherein the substrate identification device comprises:

a source detector operably connected to the nip gap controller for detecting the source of the substrate being transported.

20. The sheet transport system of claim 18, wherein the substrate identification device comprises:

a user input operably connected to the nip gap controller for receiving an input indicative of the type of the substrate to be transported.

21. The sheet transport system of claim 18, wherein the substrate identification device comprises:

a sensor operably connected to the nip gap controller for identifying the type of the substrate being transported.

* * * * *